United States Patent [19]

Niebylski et al.

[11] 4,005,993

[45] Feb. 1, 1977

[54] NOVEL GASOLINE COMPOSITIONS

[75] Inventors: Leonard M. Niebylski, Birmingham; Ellis B. Rifkin, Southfield, both of Mich.

[73] Assignee: Ethyl Corporation, Richmond, Va.

[22] Filed: Mar. 8, 1976

[21] Appl. No.: 664,505

[52] U.S. Cl. ..... 44/68; 44/70; 252/386

[51] Int. Cl.[2] ..... C10L 1/22

[58] Field of Search ..... 44/56, 66, 68, 70; 252/386

[56] References Cited

UNITED STATES PATENTS

| | | | |
|---|---|---|---|
| 2,953,587 | 9/1960 | Clinton et al. | 44/68 |
| 3,179,506 | 4/1965 | Henderson | 44/66 |
| 3,188,187 | 6/1965 | Henderson | 44/70 |
| 3,563,715 | 2/1971 | Richardson et al. | 252/386 |

*Primary Examiner*—Daniel E. Wyman
*Assistant Examiner*—Mrs. Y. Harris-Smith
*Attorney, Agent, or Firm*—Donald L. Johnson; John F. Sieberth; Robert A. Linn

[57] ABSTRACT

Gasoline compositions and additive mixtures containing compounds having the formula

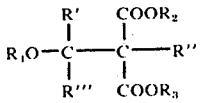

wherein $R_1$–$R_3$ and R′-R‴ are each independently selected from hydrogen, hydrocarbyl radicals, and substituted hydrocarbyl radicals, in an amount sufficient to alleviate the plugging of certain catalysts being used in an engine exhaust system to lower the amount of undesirable constituents in exhaust gas from an engine being operated on gasoline containing a cyclopentadienyl manganese antiknock.

26 Claims, No Drawings

NOVEL GASOLINE COMPOSITIONS

BACKGROUND OF THE INVENTION

Cyclopentadienyl manganese compounds are excellent antiknocks in gasoline used to operate internal combustion engines. These manganese compounds have proved to be especially beneficial in solving some of the problems present when low-lead or lead-free gasolines are used with internal combustion engines. Use of such compounds as antiknocks is described in U.S. Pat. Nos. 2,818,417; 2,839,552; and 3,127,351, incorporated herein by reference. Not only are these compounds effective antiknock compounds, but it has also been found that they do not adversely affect the activity of oxidation metal catalysts used to decrease the amount of undesirable constituents in engine exhaust gas. Under some operating conditions it has been found that, although the manganese antiknocks do not lessen the activity of the exhaust gas catalyst, they can interact in some manner at the surface of the catalyst bed leading to a reduction in the size of the openings into the bed thereby causing an increase in exhaust backpressure and a decrease in the effective life of said catalysts. The present invention provides a simple effective means of alleviating this problem.

It has been previously suggested that the addition of triethyl citrate to gasoline mixes containing organomanganese antiknocks tends to reduce catalyst plugging.

SUMMARY

According to the present invention, the useful life of an exhaust gas catalyst in an exhaust system of an engine operating on gasoline containing a cyclopentadienyl manganese antiknock is increased by providing new additive fluids and gasoline compositions which contain an amount of a compound of the general formula

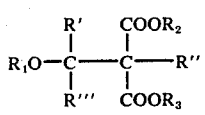

wherein $R_1$–$R_3$ and R′-R‴ are each independently selected from hydrogen, hydrocarbyl radicals, and substituted hydrocarbyl radicals, sufficient to alleviate plugging of the exhaust gas catalyst.

DESCRIPTION OF THE PREFERRED EMBODIMENTS

The essence of the present invention resides in reducing the plugging of oxidation metal catalytic apparatus for purifying exhaust gases of internal combustion engines which burn a gasoline containing an organomanganese compound. This reduction in plugging can be effected by the addition of a compound of the general formula

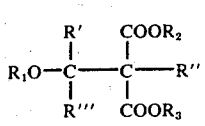

to the gasoline. Accordingly, a preferred embodiment is a gasoline suitable for use in an internal combustion engine and containing an amount of organomanganese compound, preferably a cyclopentadienyl manganese tricarbonyl, sufficient to increase its antiknock effectiveness, and also containing an amount sufficient to prevent plugging of the catalyst of a compound having the general formula

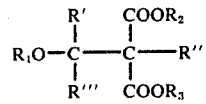

wherein $R_1$–$R_3$ and R′-R‴ are each independently selected from hydrogen, hydrocarbyl radicals, and substituted hydrocarbyl radicals.

A further embodiment of the present invention is a gasoline additive fluid composition comprising an organomanganese compound, preferably a cyclopentadienyl manganese tricarbonyl, and most preferably methylcyclopentadienyl manganese tricarbonyl, in an amount sufficient to improve the antiknock characteristics of the gasoline and compounds of the general formula

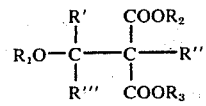

preferably the dialkyl esters of alkoxymethyl malonic acid, and most preferably diethyl ethoxymethyl malonate, in an amount sufficient to reduce catalyst plugging.

Since the invention also embodies the operation of an internal combustion engine in a manner which results in reduced plugging of the catalyst, a still further embodiment is a method of operating an internal combustion engine using a gasoline containing an organomanganese, preferably a cyclopentadienyl manganese tricarbonyl, and most preferably methylcyclopentadienyl manganese tricarbonyl antiknock in a manner which results in reduction in the plugging of the catalyst, said method comprising (a) supplying to the fuel induction system of said engine a gasoline containing an organomanganese antiknock and a gasoline soluble solution of compounds of the general formula

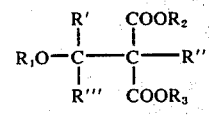

(b) mixing said gasoline with air, (c) inducting the mixture into the combustion chambers of said engine, (d) compressing said mixture, (e) igniting said compressed mixture, and (f) exhausting the resultant combustion products which have a reduced plugging effect on the catalyst through said catalyst.

Liquid hydrocarbon fuels of the gasoline boiling range are mixtures of hydrocarbons having a boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many known refining processes, such as thermal cracking, catalytic cracking, catalytic hydroforming, catalytic reforming, and the like. Generally, the final gasoline is a blend of stocks obtained from several refinery processes. The final blend may also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content of aromatic hydrocarbons ranging from 10 to about 60 volume percent, an olefinic hydrocarbon content ranging from 0 to about 30 volume percent, and a saturate hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g., BTX, catalytic reformate or the like), alkylate (e.g., $C_{6-9}$ saturates made by reacting $C_4$ olefins with isobutane using a HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerization or alkylation processes. The saturated gasoline components comprise paraffins and naphthenes. These saturates are obtained from (1) virgin gasoline by distillation (straight run gasoline), (2) alkylation processes (alkylates) and (3) isomerizaton procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column, the components being concentrated by hydrocarbon type in different parts of the column. Special fluorescent dyes are added to the test sample and are also selectively separated with the sample fractions to make the boundaries of the aromatics, olefins and saturates clearly visible under ultraviolet light. Further details concerning this method can be found in "1969 Book of ASTM Standards," January, 1969 Edition, under ASTM Test Designation D 1319-66T.

The motor gasolines used in formulating the improved fuels of this invention generally have initial boiling points ranging from about 80° to about 105° F. and final boiling points ranging from about 380° to about 430° F. as measured by the standard ASTM distillation procedure (ASTM D-86). Intermediate gasoline fractions boil away at temperatures within these extremes.

From the standpoint of minimizing atmospheric pollution to the greatest extent possible, it is best to keep the olefin content of the fuel as low as can be economically achieved as olefins reportedly give rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table I illustrates the hydrocarbon type makeup of a number of particularly preferred fuels for use in this invention.

TABLE I

| Fuel | Hydrocarbon Blends of Particularly Preferred Base Fuels — Volume Percentage | | |
|---|---|---|---|
| | Aromatics | Olefins | Saturates |
| A | 35.0 | 2.0 | 63.0 |
| B | 40.0 | 1.5 | 58.5 |
| C | 20.0 | 2.5 | 77.5 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.02 weight percent are especially preferred for use in this invention.

Normally the gasoline to which this invention is applied is lead-free or substantially lead-free, although small amounts of organolead additives usually employed to give fuels of improved performance quality such as tetraalkyllead antiknocks including tetramethyllead, tetraethyllead, physical or redistributed mixtures of tetramethyllead and tetraethyllead, and the like may be present therein. The gasoline may also contain antiknock quantities of other agents such as cyclopentadienyl nickel nitrosyl, N-methyl aniline, and the like. Antiknock promoters such as tert-butyl acetate may be included. The gasoline may also contain blending agents or supplements such as methanol, isopropanol, t-butanol, and the like. Antioxidants such as 2,6-di-tert-butylphenol, 2,6-di-tert-butyl-p-cresol, phenylenediamines such as N, N'-di-sec-butyl-p-phenylenediamine, N-isopropylphenylenediamine, and the like, may be present. Likewise the gasoline can contain dyes, metal deactivators, or other types of additives recognized to serve some useful purpose in improving the gasoline quality.

Cyclopentadienyl manganese tricarbonyls are known antiknocks and their preparation and use are described in U.S. Pat. Nos. 2,818,417; 2,839,552; and 3,127,351. An important antiknock of this type is methylcyclopentadienyl manganese tricarbonyl. The amount of the cyclopentadienyl manganese tricarbonyl added to the gasoline should be an amount adequate to increase its antiknock effectiveness. This has generally been found to be in the range of from about 0.005 to 10 grams per gallon of manganese as a cyclopentadienyl manganese tricarbonyl. A preferred range is from about 0.05 to 6 gm (grams) of manganese per gallon as a cyclopentadienyl manganese tricarbonyl. A more preferred range is from about 0.05 to about 0.25 gram of manganese per gallon, and a most preferred range is from about 0.05 to about 0.125 gram of manganese per gallon as methylcyclopentadienyl manganese tricarbonyl.

The exhaust gas purification apparatus are well known and generally employ an oxidation catalytic metal such as platinum, rhodium, palladium, or iridium or combinations thereof. Some examples of catalytic converter units are described in U.S. Pat. Nos. 3,441,381 and 3,692,497. The essential elements of such units consist of a catalytic reactor formed by an enlarged cylindrical-frustoconical housing having an inlet port and an outlet port. Located within the housing is a catalyst bed which is a honeycomb alumina-magnesia-silica monolithic ceramic-supported platinum catalyst.

In order to obtain rapid warmup required for catalyst activation, the catalytic reactor is preferably located proximate to the engine exhaust outlet. By proximate is meant that it is close enough that the catalyst bed is rapidly heated to "light off" or activation temperature. The exhaust gas temperature required to accomplish this is dependent upon the nature of the catalyst. Noble metal catalysts containing at least some noble metal such as platinum, palladium or mixtures thereof, activate at lower exhaust temperatures, e.g., 350°–500° F. However, in order to ensure activation, the catalytic reactor is preferably located such that the inlet exhaust temperature is above about 1,000° F. and more preferably above about 1,400° F. during normal engine cruise conditions. It is also at temperatures above about 1,400° F. that the cyclopentadienyl manganese antiknocks are most likely to plug the catalyst and, hence, it is under these conditions that the present invention is most useful.

In tests run with the aforementioned catalytic converters containing monolithic ceramic supports it has been found that plugging occurs by "spikes" forming on the entrance surface of the cordierite ceramic. These form a network which essentially traps large manganese particles and caps the entrance to the monolithic core.

As stated above, the exhaust gas catalyst unit uses a honeycomb, monolithic ceramic, supported platinum catalyst. These are made by coating a corrugated ceramic structure with an activated alumina and a palladium compound. The preferred ceramics are made using alumina-silica, magnesia-alumina-silica (e.g., cordierite) or mixtures thereof. Palladium can be used in nature together, it is sometimes preferred to use mixtures of platinum and palladium.

The utility of the invention in alleviating plugging with noble metal catalysts suggests its use with other catalysts if an undesirable amount of plugging is noted. Many non-noble metals have been suggested for exhaust gas catalysts. Examples of other catalytic metals include V, Cr, Mn, Fe, Co, Ni, Cu, Zn, Zr, Na, Mo, Ru, Rh, Ag, W, Re, Os, Ir, Pb, Ba, and the like. These are generally used in an oxide form. They may be used individually or in various groupings such as Cu—Cr, Cu—Cr—V, Cu—Pd, Mn—Pd, Ni—Cr and the like. They may be supported on the above monolithic ceramic support or on any other of numerous well-known catalyst supports such as granular, pelletized, or extruded alumina, silica, silica-alumina, zirconia, magnesia, alumina-magnesia and the like.

The antiplugging agents of the present invention are known compounds whose preparation is known in the art. These compounds have the general formula

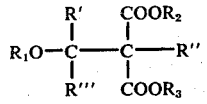

I wherein $R_1$–$R_3$ and R′-R‴ are each independently selected from hydrogen, hydrocarbyl radicals, and substituted hydrocarbyl radicals. In a preferred embodiment of the present invention $R_1$–$R_3$ are each independently selected from hydrocarbyl and substituted hydrocarbyl radicals while R′-R‴ are each independently selected from hydrogen, hydrocarbyl radicals, and substituted hydrocarbyl radicals. Preferably, the hydrocarbyl radicals are those that contain up to about 20 carbon atoms. The more preferred hydrocarbyl radicals are the lower alkyls of up to about 10 carbon atoms. The most preferred hydrocarbyls are methyl and ethyl. For purposes of this invention a hydrocarbyl radical can be defined as an organic group solely composed of hydrogen and carbon atoms. Some non-limiting representative examples of hydrocarbyl radicals are alkyl, cycloalkyl, alkenyl, aralkyl, alkaryl, and aryl.

Examples of suitble alkyl groups are methyl, ethyl, n-propyl, isopropyl, n-butyl, isobutyl, sec-butyl, tert-butyl, n-amyl, and the various positional isomers thereof, and likewise the corresponding straight and branched chain isomers of hexyl, heptyl, octyl, nonyl, decyl, undecyl, dodecyl, and the like.

Some examples of cycloalkyl groups are cyclopropyl, cyclobutyl, cyclopentyl, cyclohexyl, cycloheptyl, cyclooctyl, cyclonoyl, cyclodecyl, cycloundecyl, cyclododecyl, and the like. They may also be such cycloaliphatic groups as α-cyclopropyl-ethyl, α-cyclobutyl-propyl, β-cyclobutyl-propyl, and similar alkyl derivatives of the higher cycloalkyls.

Some examples of alkenyl groups are ethenyl, 1-propenyl, 2-propenyl, isopropenyl, 1-butenyl, 2-butenyl, 3-butenyl, and the corresponding branched-chain isomers thereof as for example, 1-isobutenyl, 2-isobutenyl, 2-sec-butenyl, including 1-methylene-2-propenyl, and the various isomers of pentenyl, hexenyl, heptenyl, octenyl, nonenyl, decenyl, undecenyl, and dodecenyl, including 3,3-dimethyl-1-butenyl, 2,3-dimethyl-1-butenyl, 2,3-dimethyl-2-butenyl, 2,3-dimethyl-3-butenyl, 1-methyl-1-ethyl-2-propenyl, and the like.

Examples of alkaryl groups are tolyl, 2,3-xylyl, 2,4-xylyl, 2,5-xylyl, 2,6-xylyl, 3,4-xylyl, 3,5-xylyl, o, m, and p-cumenyl, mesityl, o, m, and p-ethylphenyl, 2-methyl-1-naphthyl, 3-methyl-1-naphthyl, 4-methyl-1-naphthyl, 5-methyl-2-naphthyl, 6-methyl-3-naphthyl, 7-methyl-1-naphthyl, 8-methyl-4-naphthyl, 1-ethyl-2-naphthyl, and its various positional isomers and the like.

Examples of aryl groups which may be present in the above general formula are phenyl, napthyl, and the like.

Examples of aralkyl groups are benzyl, phenylethyl, 1-phenylpropyl, 2-phenylpropyl, 3-phenylpropyl, 1- and 2-isomers of phenylisopropyl, 1-, 2-, and 3-isomers of phenylbutyl, and the like.

The substituted hydrocarbyl radicals are hydrocarbyl radicals which contain substituents such as halogen, hydroxyl, carboxyl, alkoxycarbonyl, amino, or amide radicals.

As mentioned above, the hydrocarbyl groups may be halogen substituted. Thus, chlorine, bromine, iodine, and fluorine may be substituted on the alkyl, cycloalkyl, alkenyl, alkaryl, aryl, and aralkyl groups which are present. Non-limiting examples of such substituted groups are chloromethyl, chloroethyl, bromoethyl, 2-fluoro-1,2-dibromoethyl, 1-iodopropyl, 2-fluoropropyl, 1-chlorobutyl, 2-bromobutyl, 2-iodo-2-methylpropyl, 1-chloropentyl, 3-fluoro-2-methylbutyl, 3-iodo-2-methylbutyl, 1-chloro-2,2-dimethylpropyl, 2-chloroheptyl, 3-fluorononyl, 1-chlorododecyl, and the like. Examples of halogenated cycloalkyl groups are chlorocyclopropyl, chlorocyclohexyl, 1,2-dichlorohexyl, bromocyclobutyl, iodocyclohexyl, and the like.

Examples of halogen-substituted alkenyl groups are bromoethenyl, chloroethenyl, iodoethenyl, 1-bromododecenyl, and the like.

Examples of halogenated alkaryl groups are chloro-o-tolyl, chloro-p-tolyl, chloro-m-tolyl, 2-bromo-3,4-xylyl, 4-bromo-2,3-xylyl, 5-bromo-2,4-xylyl, 2-bromo-4,5-xylyl, o-, m-, and p-tolyl, 3-bromomesityl, chloro(-methyl)-1-naphthyl, iodo(ethyl)-1-naphthyl, all positional isomers of the above, and the like.

Examples of halogen substituted aryl groups are bromophenyl, 2-bromo-1-naphthyl, 3-bromo-1-naphthyl and all positional isomers thereof, 2,4-dibromophenyl, 2,3-dibromophenyl, 2,5-dibromophenyl, 2,3,4,5-tetrabromophenyl, 2,3,5,6-tetrabromophenyl, pentabromophenyl, all isomers of chlorophenyl, and all isomers of multichlorophenyl: 2-chloro-1-naphthyl and the remaining isomers thereof: 2,3-dichloro-1-naphthyl, 2,4-dichloro-1-naphthyl and the remaining positional isomers of dichloronaphthyl, 2,3,4,5-tetrachloro-1-naphthyl.

Amine groups may also be substituted on the hydrocarbyl groups. Some non-limiting illustrative examples of hydrocarbyl groups containing amine substituents are aminomethyl, 2-aminoethyl, 2,2-diaminoethyl, 2-aminoisopropyl, 5-aminopentyl, 1,2-aminododecyl, 1,2-diaminoethyl, 1,5-diaminopentyl, aminocyclobutyl, aminocyclohexyl, 3-amino-1-propen-1-yl, 5-amino-2-penten-1-yl, aminophenyl, (methylamino)phenyl, 2-amino-o-tolyl, 4-amino-m-tolyl, 3-amino-p-tolyl, and other positional isomers, various isomers of diaminophenyl, amino-2,5-xylyl, and various positional isomers thereof, 2-amino-1-naphthyl, 3-amino-1-naphthyl, 2-amino-3-methyl-1-naphthyl, 2,3-diamino-5-ethyl-1-naphthyl, and the like.

The hydrocarbyl groups may contain amide groups which may be illustrated by such non-limiting examples as: carbamoylmethyl, 2-carbamoylethyl, 4-carbamoylbutyl, 8-carbamoyl-2-ethyloctyl, 1,4-dicarbamoylbutyl, carbamoylcyclopentyl, carbamoylcyclohexyl, 2-carbamoyl-o-tolyl, 2-carbamoyl-m-tolyl, 3-carbamoyl-p-tolyl, (carbamoylmethyl)phenyl, (2-carbamoylethyl)-benzyl; o-, m-, and p-(carbamoylethyl)phenyl, and the like.

In order to be most advantageously employed as antiplugging agents, the above compounds should be readily soluble, either directly or indirectly, in the gasoline.

Furthermore, these compounds should be volatile enough to volatilize under the conditions of temperature and pressure existent in the engine. The aforedescribed compounds should also not adversely affect or react in the gasoline.

The amount of antiplugging compound described above sufficient to reduce the plugging of the catalyst is at least to some extent dependent upon the amount of manganese present in the gasoline and on the inlet exhaust temperature. Generally, the greater the concentration of manganese and the higher the temperature the greater the amount of antiplugging compound needed to reduce plugging of the catalyst.

The lower limit at which the antiplugging compounds of the present invention are generally believed to be effective to reduce plugging is generally about 0.01 g/gal. Preferably, the amount of the compound is greater than 0.03 g/gal, and more preferably greater than 0.125 g/gal. There is generally believed to be no real upper limit on the concentration of the antiplugging compound, and, accordingly, the upper limit is restricted by such secondary considerations as economics, etc. Thus, since the amount of the antiplugging compound is generally dependent upon the concentration of the manganese, for practical purposes the upper limit is about 10 g/gal.

It is convenient to utilize additive fluid mixtures composed of cyclopentadienyl manganese tricarbonyl antiknock agents and antiplugging agents described above. These additive fluid mixtures can be added to low-lead or unleaded gasoline. In other words, part of the present invention are antiknock-antiplug additive fluids which comprise cyclopentadienyl manganese tricarbonyl antiknock agents and the antiplugging agents of the type described hereinabove.

Use of such antiknock-antiplug fluids in addition to resulting in great convenience in storage, handling, transportation, blending with fuels, and so forth, also are potent concentrates which serve the multipurpose functions of being useful as antiknocks, and catalyst plugging reducers.

In these fluid compositions the weight ratio of manganese-to-antiplugging agent can generally vary from about 0.03 gram of antiplugging agent to 1 gram of manganese or even 0.01 gram of the antiplugging agent to 1 gram of manganese on the one hand to about 10 grams of the antiplugging agent to about 1 gram of manganese on the other hand. The additive fluid concentrates may optionally contain other additives such as antioxidants, antirust agents, demulsifiers, detergents, solvents such as aromatic hydrocarbons, and the like.

Useful gasoline compositions are those which contain from about 0.005 to about 10 grams, that is an antiknock amount, of manganese per gallon as a cyclopentadienyl manganese tricarbonyl wherein said cyclopentadienyl group is a hydrocarbon group and an amount sufficient to reduce plugging of an exhaust gas catalyst of the antiplugging compounds of formula I.

A useful gasoline composition is gasoline A of Table I to one gallon of which can be added 0.2 gram of the diethyl ethoxymethyl malonate and 4 grams of methylcyclopentadienyl manganese tricarbonyl.

Another useful gasoline composition is gasoline B of Table I to one gallon of which can be added 0.025 gram of diethyl ethoxymethyl malonate and 0.5 gram of methylcyclopentadienyl manganese tricarbonyl.

A useful additive fluid composition is one which can contain 0.25 gram of diethyl ethoxymethyl malonate and 5 grams of methylcyclopentadienyl manganese tricarbonyl. If this fluid is added to 10 gallons of gasoline, as of gasoline C in Table I, a gasoline composition containing 0.5 gram/gallon of methylcyclopentadienyl manganese tricarbonyl and 0.025 gram/gallon of diethyl ethoxymethyl malonate can be obtained.

Although the preferred antiplugging compounds have the general formula

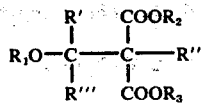

wherein $R_1$–$R_3$ and R′-R‴ have been previously described, it is believed that compounds having the skeletal structures

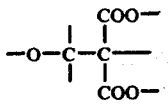

will have useful properties in reducing the plugging of exhaust catalysts. A limiting factor regarding the numbers of types of substituent is that these groups do not make the compound insoluble in gasoline to such a degree that an effective amount of compound cannot be added; do not make the compound unstable in gasoline under the operating conditions existent in the engine; and do not reduce the volatility of the compound to such an extent that said compound does not volatilize under operating conditions existent in the engine.

Although the compounds of the present invention have the most utility when added to gasoline, they can also be used in conjunction with other liquid petroleum distillate fuels such as kerosene, diesel fuel, jet engine fuel, and the like.

Claims to the invention follow.

We claim:

1. As a composition of matter, a gasoline for an internal combustion engine comprising
   i. an antiknock amount of a cyclopentadienyl manganese tricarbonyl antiknock compound, and
   ii. an amount sufficient to reduce plugging of an exhaust gas catalyst of a compound having the general formula:

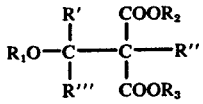

wherein $R_1$–$R_3$ and R′-R‴ are each independently selected from hydrogen, hydrocarbyl radicals, and substituted hydrocarbyl radicals.

2. The composition of claim 1 wherein said cyclopentadienyl group is a hydrocarbon group containing from 5 to about 17 carbon atoms.

3. The composition of claim 2 wherein said cyclopentadienyl group is methylcyclopentadienyl.

4. The composition of claim 3 wherein said hydrocarbyl radical is an alkyl radical having from 1 to about 20 carbon atoms.

5. The composition of claim 4 wherein $R_1$–$R_3$ are each independently selected from hydrocarbyl and substituted hydrocarbyl radicals.

6. The composition of claim 5 wherein $R_1$, $R_2$ and $R_3$ are ethyl radicals.

7. The composition of claim 5 wherein R′, R″ and R‴ are hydrogen.

8. The composition of claim 6 wherein R′-R‴ are hydrogen.

9. A substantially lead-free gasoline for use with a noble metal exhaust gas purification catalyst, said gasoline comprising
   i. a cyclopentadienyl manganese tricarbonyl antiknock compound in an amount sufficient to improve the antiknock characteristics of said gasoline, and
   ii. a compound in an amount sufficient to reduce plugging of said noble metal exhaust gas purification catalyst, said compound having the general formula:

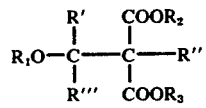

wherein $R_1$–$R_3$ and R′-R‴ are each independently selected from hydrogen, hydrocarbyl radicals, and substituted hydrocarbyl radicals.

10. The gasoline of claim 9 wherein said cyclopentadienyl group is a hydrocarbon group containing from 5 to about 17 carbon atoms.

11. The gasoline of claim 10 wherein said cyclopentadienyl group is methylcyclopentadienyl.

12. The gasoline of claim 11 wherein said hydrocarbyl radical is an alkyl radical having from 1 to about 20 carbon atoms.

13. The gasoline of claim 12 wherein $R_1$-$R_3$ are each independently selected from hydrocarbyl and substituted hydrocarbyl radicals.

14. The gasoline of claim 13 wherein $R_1$, $R_2$ and $R_3$ are ethyl radicals.

15. The gasoline of claim 12 wherein R′, R″ and R‴ are hydrogen.

16. The gasoline of claim 14 wherein R′, R″ and R‴ are hydrogen.

17. An additive fluid for gasoline comprising
   i. a cyclopentadienyl manganese tricarbonyl antiknock compound, and
   ii. a compound having the general formula:

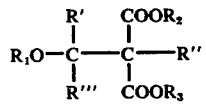

wherein $R_1$–$R_3$ and R′-R‴ are each independently selected from hydrogen, hydrocarbyl radicals, and substituted hydrocarbyl radicals.

18. The additive fluid of claim 17 wherein said fluid contains an antiknock amount of said cyclopentadienyl manganese tricarbonyl antiknock compound.

19. The additive fluid of claim 17 wherein said fluid contains an amount sufficient to reduce the plugging of an exhaust gas catalyst of the compound having the general formula:

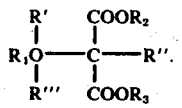

20. The additive fluid of claim 17 wherein said cyclopentadienyl group is a hydrocarbon group containing from 5 to about 17 carbon atoms.

21. The additive fluid of claim 20 wherein said cyclopentadienyl group is methylcyclopentadienyl.

22. The additive fluid of claim 21 wherein said hydrocarbyl radical is an alkyl radical having from 1 to about 20 carbon atoms.

23. The additive fluid of claim 20 wherein $R_1$–$R_3$ are each independently selected from hydrocarbyl and substituted hydrocarbyl radicals.

24. The additive fluid of claim 23 wherein $R_1$, $R_2$ and $R_3$ are ethyl radicals.

25. The additive fluid of claim 23 wherein R′, R″ and R‴ are hydrogen.

26. The additive fluid of claim 24 wherein R′, R″ and R‴ are hydrogen.

* * * * *